US007832350B2

(12) United States Patent
Mora et al.

(10) Patent No.: US 7,832,350 B2
(45) **Date of Patent: *Nov. 16, 2010**

(54) LIFEBOAT DISENGAGEMENT SYSTEM

(75) Inventors: Tony Mora, Julian, CA (US); Sidney Medley, Menifee, CA (US); Russell Tuckerman, Escondido, CA (US); Roger Lopez, El Cajon, CA (US)

(73) Assignee: Survival Systems International, Inc., Valley Center, CA (US)

( * ) Notice: Subject to any disclaimer, the term of this patent is extended or adjusted under 35 U.S.C. 154(b) by 630 days.

This patent is subject to a terminal disclaimer.

(21) Appl. No.: 11/841,844

(22) Filed: Aug. 20, 2007

(65) Prior Publication Data

US 2008/0084078 A1 Apr. 10, 2008

Related U.S. Application Data

(63) Continuation-in-part of application No. 11/742,130, filed on Apr. 30, 2007, now Pat. No. 7,360,498, which is a continuation-in-part of application No. 11/539,152, filed on Oct. 5, 2006, now Pat. No. 7,412,941.

(51) Int. Cl.
*B63B 23/00* (2006.01)

(52) U.S. Cl. ..... 114/378; 294/82.27

(58) Field of Classification Search ..... 294/82.24, 294/82.27, 82.33; 114/365, 377–380
See application file for complete search history.

(56) References Cited

U.S. PATENT DOCUMENTS

| | | | | | |
|---|---|---|---|---|---|
| 1,246,468 | A | * | 11/1917 | Robinson | 114/380 |
| 1,742,092 | A | * | 12/1929 | Overman | 114/380 |
| 2,714,731 | A | * | 8/1955 | Binmore | 114/378 |
| 2,800,667 | A | * | 7/1957 | Staudt | 114/380 |
| 4,106,144 | A | | 8/1978 | Chabot | |
| 4,281,867 | A | * | 8/1981 | Kariagin | 294/82.33 |
| 4,348,043 | A | | 9/1982 | Fandel | |
| 4,461,233 | A | * | 7/1984 | Nilsson | 114/378 |
| 4,610,474 | A | * | 9/1986 | Jaatinen | 294/82.27 |
| 4,822,311 | A | | 4/1989 | Doerffer et al. | |
| D310,058 | S | | 8/1990 | Thompson et al. | |
| 5,078,073 | A | * | 1/1992 | Betz et al. | 114/377 |
| 7,360,498 | B1 | * | 4/2008 | Mora et al. | 114/378 |
| 7,412,941 | B2 | * | 8/2008 | Mora et al. | 114/378 |

* cited by examiner

*Primary Examiner*—Dean J Kramer
(74) *Attorney, Agent, or Firm*—David E. Heisey; Sheppard, Mullin, Richter & Hampton LLP

(57) ABSTRACT

The present invention provides a system for supporting and releasing a twin fall lifeboat, comprising a pair of hooks releasably engaged with a corresponding pair of lifting links; and a lifeboat release assembly. The lifeboat release assembly includes a release handle, a release arm, an emergency release shaft, a weighted rack, and a pair of flexible cables attached at first ends to the rack and attached at second ends to the hooks. The release handle attaches to the release arm at a pivot point. The release arm includes a wheel disposed within a wheel encasement attached to the weighted rack. The system includes an engaged configuration in which the lifting links are secured by the hooks. The release handle is pulled to release the lifting links from the hooks substantially simultaneously. An emergency ratchet lever engages with the emergency release shaft for releasing the twin fall lifeboat under load.

22 Claims, 11 Drawing Sheets

LIFEBOAT DISENGAGEMENT SYSTEM

CROSS-REFERENCE TO RELATED APPLICATIONS

This application is a continuation-in-part of U.S. patent application Ser. No. 11/742,130, filed Apr. 30, 2007 now U.S. Pat. No. 7,360,498, which is a continuation-in-part of U.S. patent application Ser. No. 11/539,152, filed Oct. 5, 2006 now U.S. Pat. No. 7,412,941, the content of both applications are included herein by reference in its entirety.

FIELD OF THE INVENTION

The present invention relates generally to hooking and engagement systems for lifeboats, and more particularly, to a lifeboat disengagement system for supporting and releasing twin fall lifeboats.

BACKGROUND OF THE INVENTION

In heavy industry, military and maritime situations, hooks are provided on a piece of equipment in order to make it more mobile, or to allow for it to be transferred from location to location. In these circumstances, large cranes are utilized, and the chain or cable of the crane is provided with a large loop or ring which is engaged with the piece of equipment to be moved. Depending upon the particular use, it may be desirable to have a hook which can be opened either under full load, or without load. One conventional hook available in the industry is a type that can be opened under load by use of a long line or chain that actuates a releasing mechanism, whereby the hook is released under load. The disadvantage of this form is that the hooks are not easy to set or release when not under load. In another form, the action of releasing of the load by placement or by other means automatically releases the hook, and thus terminates the connection between the cable and the device being lifted.

One particular use of this type of equipment is the support of lifeboats aboard ship and on drilling platforms. Lifeboats may comprise enclosed boats that are used on commercial vessels, cruise ships, and off-shore platforms. Twin fall lifeboats are supported by a pair of cables on hoists so that they may be loaded or entered and quickly lowered over the side of a ship or off the side of a platform. Vessels of this type have particular need for a hook locking mechanism which cannot be released under load without substantial inconvenience and the requirement of conscious and deliberate steps to manually release the locking mechanism. This is accomplished by disengaging the coupling to the manual release drive means (e.g., a hand crank for driving the release mechanism) and stowing it in a location separate from the lock release drive mechanism.

Changes in lifeboat launching arrangements have been characterized by slow evolution driven by regulatory change. One change that is particularly relevant was the introduction by the International Maritime Organization (IMO) in 1986 of a regulatory requirement for on-load release hooks. Prior to this time, after lowering a boat into the water, it was necessary manually to unhook the boat from its falls. As boats and their launching gear became larger and heavier, this task had become fraught with danger as crew tried to complete a simultaneous (fore-and-aft) unhooking process. The requirement for on-load release hooks was introduced to overcome these problems, in the expectation that launching would become significantly safer. In practice, on-load release hooks have brought their own problem, with accidents being reported sufficiently frequently for a clear picture to emerge about the types of failure and range of consequences (in terms of seafarer injuries and fatalities) that typically occur. The well-known nature of the problem is illustrated by the publication of two industry surveys. The first was compiled in 1994 by the Oil Companies International Marine Forum (OCIMF), based on a questionnaire distributed via the International Chamber of Shipping and selected Flag State Administrations. A total of 92 incidents were identified, 41% of which resulted in injury, with 2 incidents leading to fatalities. OCIMF also noted a lack of confidence amongst mariners leading to reluctance to conduct lifeboat drills. Recommendations were addressed to ship owners, manufacturers and authorities (including the IMO), and it is therefore to be assumed that these various organizations were made aware of the survey findings.

Accident reports make it clear that most accidents to date have occurred during routine drills, maintenance and testing. During these activities, it is usually only members of the ship's crew who are at risk should an accident occur. It also appears that few lifeboat accidents in recent times have occurred during use of the lifeboat in earnest in an emergency abandon ship scenario. The occurrence of serious accidents involving lifeboat on-load release hooks, resulting in injury to or death of seafarers, is an ongoing problem in the shipping industry. Such confidential incident reports highlight both the mechanical problems associated with lifeboat launching arrangements and the resulting lack of confidence amongst seafarers about their safety during lifeboat drills. However, it is evident from the various reports of lifeboat accidents that those involving unexpected or unintended release of the suspension hooks are likely to be the most serious accidents, often leading to fatalities. Preventing or minimizing the occurrence of "hook" accidents would therefore make a major contribution to risk reduction.

In many cases, the failure of on-load hooks is not so much of the hook itself, but more a failure of the release mechanism. To understand the significance of this it is necessary to understand how a typical on-load release hook functions. FIG. 1 (Prior Art) illustrates the working parts of a conventional on-load hook design. Many other manufacturers' designs are believed to operate on equivalent or similar principles. The opening part of the hook may rotate about a swivel pin, which is supported by two side plates of the hook (shown by the long solid line which loops around the top of the swivel pin). The weight of the boat is supported by these side plates, which exert a downward force on the swivel pin. The force is opposed by the tension in the falls, transmitted to the opening part of the hook via the suspension ring. The circular cross section of the suspension ring is seen in the bight of the hook, with an upward force arrow labeled "Hook's load". The weight of the boat acting downwards at the center of the swivel pin, together with the load in the falls acting upwards at the center of the suspension ring, creates a couple, or an equal and opposite pair of forces acting parallel to each other. This couple tends to rotate the hook in a counter-clockwise direction to open the hook. However, this tendency to open is prevented by the cam.

With further reference to FIG. 1 (Prior Art), the cam comprises a semi-circular shape, wherein an upper part of this cam prevents the hook rotating in a counter-clockwise direction. The cam can rotate about a center of rotation marked "+" in the figure which also shows the hook's tail force pushing on the cam. There is an equal and opposite reaction force from the cam pushing on the tail of the hook. This reaction force acts in a clockwise direction on the hook, balancing the counter-clockwise tendency created by the weight of the boat.

The lowest part of the tail of the hook lies above the cam's center of rotation such that if the cam is rotated clockwise around this center, the cam will no longer be in contact with the tail of the hook. Under the influence of a counter-clockwise couple, the hook will open and fall away. Clockwise rotation of the cam is achieved by means of a downwards pull on the cable causing rotation of the cam crank. The cable is connected to the operating lever located adjacent to the coxswain's position in the boat. Since the tail of the hook lies above the cam's center of rotation, the hook's tail force exerts a turning moment on the cam which tends to rotate the cam in a clockwise direction. If allowed to occur, this rotation results in release of the hook. Only the positioning of the cam crank, as dictated by the cable and operating lever, prevents the hook forcing itself open under the action of the couple generated by the boat's weight and tension in the falls.

Many on-load hook designs (including the hook design of FIG. 1) are inherently "unstable" because the weight of the boat suspended on the hook tends to produce a hook opening effect, which has to be resisted by the operating mechanism for the hook to stay closed. Thus the operating mechanism (lever, cable and cam crank) serves not only to release the boat when required, but also to maintain the hook closed at all other times. Any deficiency in the operating mechanism impacts directly on the ability of the hook to remain closed and support the boat. Consequently, many on-load release hooks currently in use are inherently unsafe.

A well-known problem exists with respect to unstable hooks in twin fall lifeboats. This problem was studied in detail by the Maritime and Coastguard Agency (MCA), which concluded that many existing on-load release hooks are inherently unsafe and therefore unfit for use with twin fall lifeboats. The study determined that lifeboat accidents occur for a number of reasons, and that most of the more serious accidents (particularly those involving fatalities), occur because of problems with the on-load release hooks. For example, through the premature or unexpected opening of one or both hooks during a routine test or drill, the lifeboat either becomes suspended vertically or drops completely into the water, frequently resulting in injuries and/or fatalities.

Unsafe situations often arise because many on-load hooks have a tendency to open under the effect of the lifeboat's own weight and need to be closed using an operating mechanism. As a result, there is no defense against: (1) defects/faults in the operating mechanism; (2) errors by the operator; or (3) incorrect resetting of the hook after being released. The MCA concluded that unstable hooks are the primary reason for almost all serious accidents involving lifeboats, and that the solution lies in a radical re-design of the hook types involved. In addition, the MCA recommended that all on-load release hooks be designed and constructed to be stable (i.e., self-closing) when supporting the weight of the lifeboat. Moreover, the MCA suggested that unstable designs of on-load release hooks are identified with the intention that they be withdrawn from service on all ships and urgently replaced with stable designs.

SUMMARY OF THE INVENTION

The present invention provides a system for supporting and releasing a twin fall lifeboat, comprising a pair of hooks releasably engaged with a corresponding pair of lifting links, and a lifeboat release assembly including a release handle, a release arm, a weighted rack, and a pair of flexible cables attached at first ends to the rack and attached at second ends to the hooks, wherein the release handle is attached to the release arm at a pivot point, wherein the release arm includes a wheel disposed within a wheel encasement attached to the weighted rack, wherein the system includes an engaged configuration in which the lifting links are secured by the hooks, and wherein the release handle is pulled by an operator, rotating the release arm about the boss, thereby lifting the weighted rack and pulling the flexible cables release the lifting links from the hooks substantially simultaneously.

In the above-described system, the rotation of the release arm about the boss causes the wheel to rotate transversely within the wheel encasement while the weighted rack is being lifted. The release arm comes to rest beyond the vertical center of rotation thereby holding the hook in the disengaged configuration until such time as the operator closes the hook for lifeboat retrieval. According to some embodiments, the flexible cables are attached to the weighted rack using Heim joints. The system provides positive locking under load including a load over center design such that a load of the lifeboat is in line with a center of hook rotation. The load over center design prevents the hook from opening inadvertently and eliminates the need for a hydrostatic device. In a preferred implementation of the invention, the hooks comprise stable hooks wherein the load of the lifeboat locks the hooks such that they do not release under load.

The release handle is pulled by an operator to release the lifting links from the hooks once the lifeboat is afloat in water. Each hook is positioned between a pair of plates and is capable of rotating about a shaft, wherein the hook includes an engaging surface that is provided with a predetermined arcuate shape. The plates include a release surface which is vertically extended and curved relatively toward a rearward portion of the hook, wherein the release surface acts to positively disengage the lifting link held by the hook during disengagement. The system may further comprise a counter weighted retainer which captures a lifting link before a load is applied. According to the invention, the hook is engaged with the lifting link by passing the lifting link between the hook and the counter weighted retainer, overcoming the gravity of the counter weight. After engagement, the counter weighted retainer returns to its original closed position, such that a distal end of the counter weighted retainer is in close proximity to a distal end of the hook.

The system of the invention may further comprise an emergency ratchet lever for use in releasing the twin fall lifeboat under load. In particular, the emergency ratchet lever is configured to be engaged onto the square end of the emergency release shaft of the lifeboat release assembly and pulled in a counter-clockwise direction to release twin fall lifeboat under load. The square end is disposed on a keyed shaft on which a keyed pinion is mounted, wherein the keyed pinion engages a plurality of teeth of the weighted rack, such that when the emergency ratchet lever is pulled, the weighted rack is caused to move in an upward direction, thereby pulling the cables and releasing the loaded hooks. In some embodiments of the invention, the ratchet lever is rotated through 90° four or five times in order to lift the weighted rack and disengage the hooks while under load.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

Embodiments of the present invention will now be described, by way of example only, with reference to the following drawings, in which.

DETAILED DESCRIPTION OF THE PREFERRED EMBODIMENTS

Figure 1:
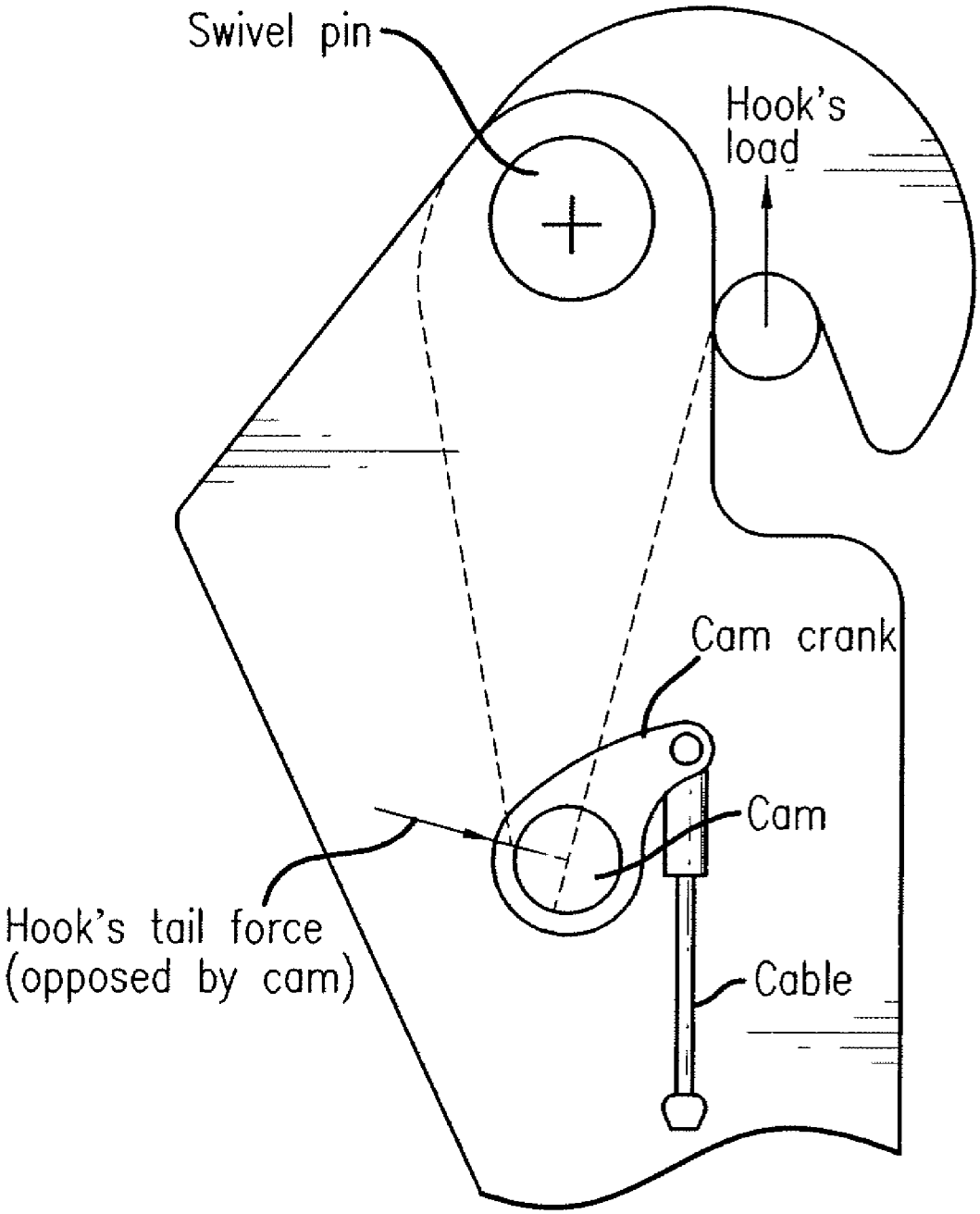
FIG. 1 PRIOR ART
FIG. 1 (Prior Art) is a perspective view of a conventional on-load hook design.

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

The present invention is directed to a lifeboat disengagement system for supporting and releasing twin fall boats, wherein the disengagement system provides positive locking under load until the tension is removed from the falls and the release handle is pulled to disengage the pair of hooks simultaneously. Unlike conventional systems, the lifeboat disengagement system of the present invention features a pair of stable hooks, wherein the load of the lifeboat locks the hooks such that they do not release under load. In other words, the disengagement system is designed so the load of the boat is not employed to open the hook. This locking design protects the occupants of the boat while it is being lowered into the water or while it is being lifted out of the water. Even if an operator, in error, attempts to pull on the hook release lever while the boat is suspended in the air, the stable hooks will not open. In addition, should a part fail or malfunction, the hooks will not open. Once the boat is afloat in the water and the load is removed from the hooks, the operator may then pull the hook release lever and open the hook.

According to the principles of the present invention, the stable hook design set forth herein permits the lifeboat floating in the water to replace, or to be used in lieu of, a troublesome conventional hydrostatic release valve. Advantageously, the hooks of the invention include less parts than conventional hooks, and are therefore less complex in design and easier to maintain. Additionally, the hooks offer the seafarer greater safety than that afforded by conventional hooks having a hydrostatic release valve. The hooks of the invention provide positive locking under load because of a load over center design, wherein the load is in line with the center of hook rotation, thereby preventing the hook from opening inadvertently and eliminating the need for a hydrostatic device. The hooks of the invention are also relatively simple to operate in that: (1) if the operator can pull the hook release handle and move it, the boat is safely afloat in the water, and the hooks will open; or (2) if the operator pulls on the hook release handle and cannot move it, either the boat is suspended in the air or a tension remains in the falls, and the hooks will not open.

Regulation requires that in an emergency the hook design provides an ability to release the hooks when under load. According to one embodiment of the invention, this is accomplished by manually installing an emergency ratchet lever onto the square end of the emergency release shaft. In the system of the invention, a pair of hooks is mounted on a top surface of a lifeboat. Each hook may include a housing comprising a metal plate manufactured or bolted to the lifeboat, wherein the housing is provided with an independent servicing or hoisting flange having a circular opening for attaching to and lifting of the lifeboat.

Each hook that is utilized as a connection between a hoist and the lifeboat is rotatably pinned between a pair of plates which form the housing. The housing may be provided with a covering to prevent environmental contamination or damage. The hook includes an engaging surface that contacts the cable or lifting link. Specifically, the engaging surface includes the shaped portion of the hook, and is positioned such that, upon release and rotation of the hook, the face of the housing assists in the positive disengaging of the link from the hook. A retaining device may be provided and positioned, such that in a released configuration, the retaining device either contacts or comes very close to contacting a small pointed end of the hook in its engaged configuration, thereby preventing the link from accidentally being separated from the hook in its no-load configuration. In addition, a biasing feature of the retaining device is positioned such that the securing function can be overcome easily by pressure during inserting of the link, but cannot be overcome by the reverse motion.

According to the invention, each hook has a pivot point positioned such that the engaging surface for the hook and the housing cooperate to produce a vertical relationship between the pivot point of the hook and the contact point of the attaching link with the hook surface. The engaging surface may be dimensioned such that the surface forms a constant radius arc, independent of rotation of the hook, about the pivot point of the hook. In operation, the hook is placed in its locked position, and a link is placed through the exposed portion of the hook. The counterweighted retaining device locks the structure preventing the hook from becoming disengaged upon accidental loss of tension in the cable/fall supporting the link and the remaining portions of the apparatus are locked in position by placing of a load on the link. The counterweighted rack remains in its locked condition under the load until such time as the load becomes sufficiently small such that the operator may pull the release handle such that the hooks disengage from the links contained therein.

Figure 2:
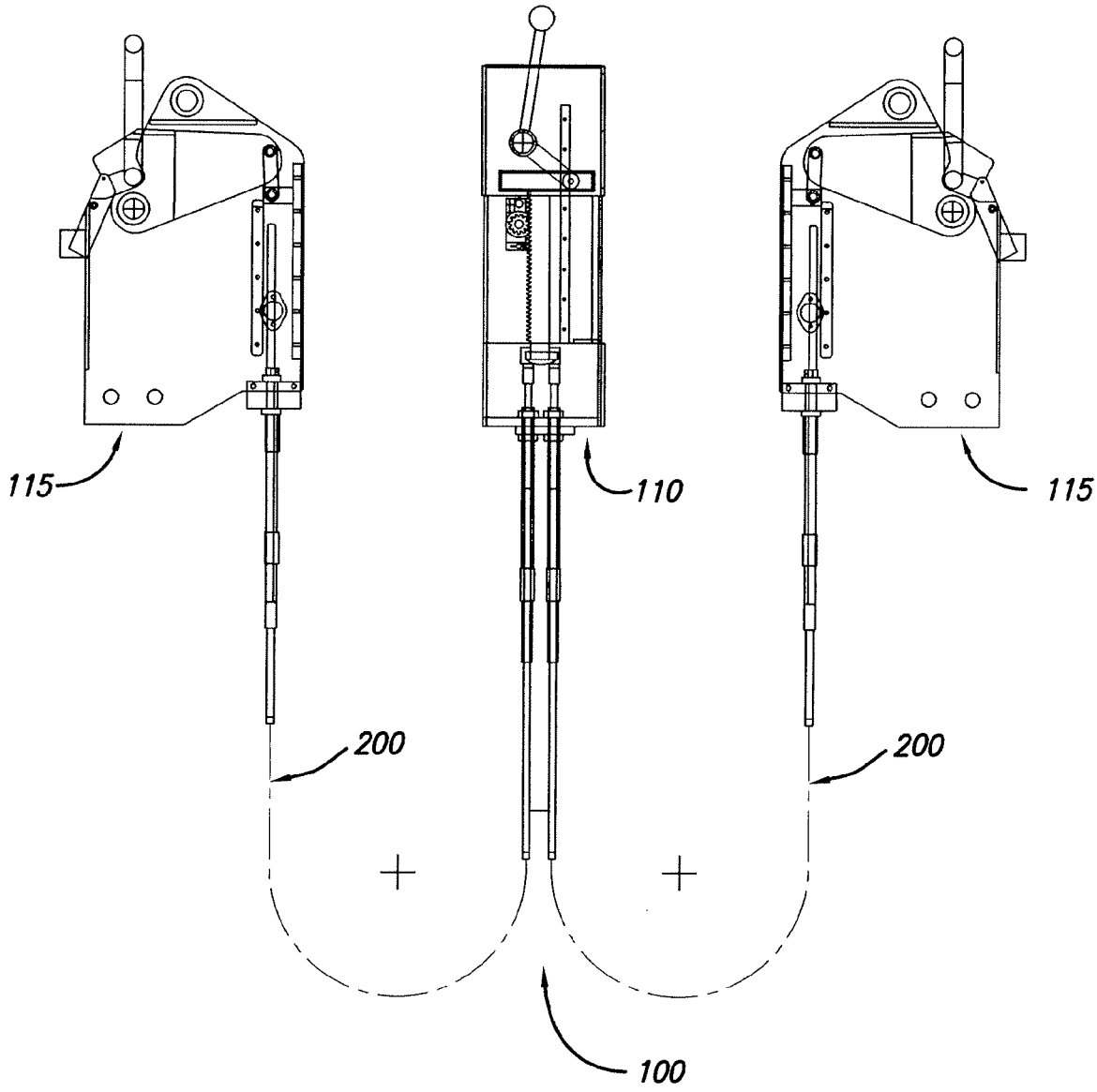
FIG. 2 is a side view of a lifeboat disengagement system in an engaged configuration, in accordance with the principles of the present invention.
Figure 3:
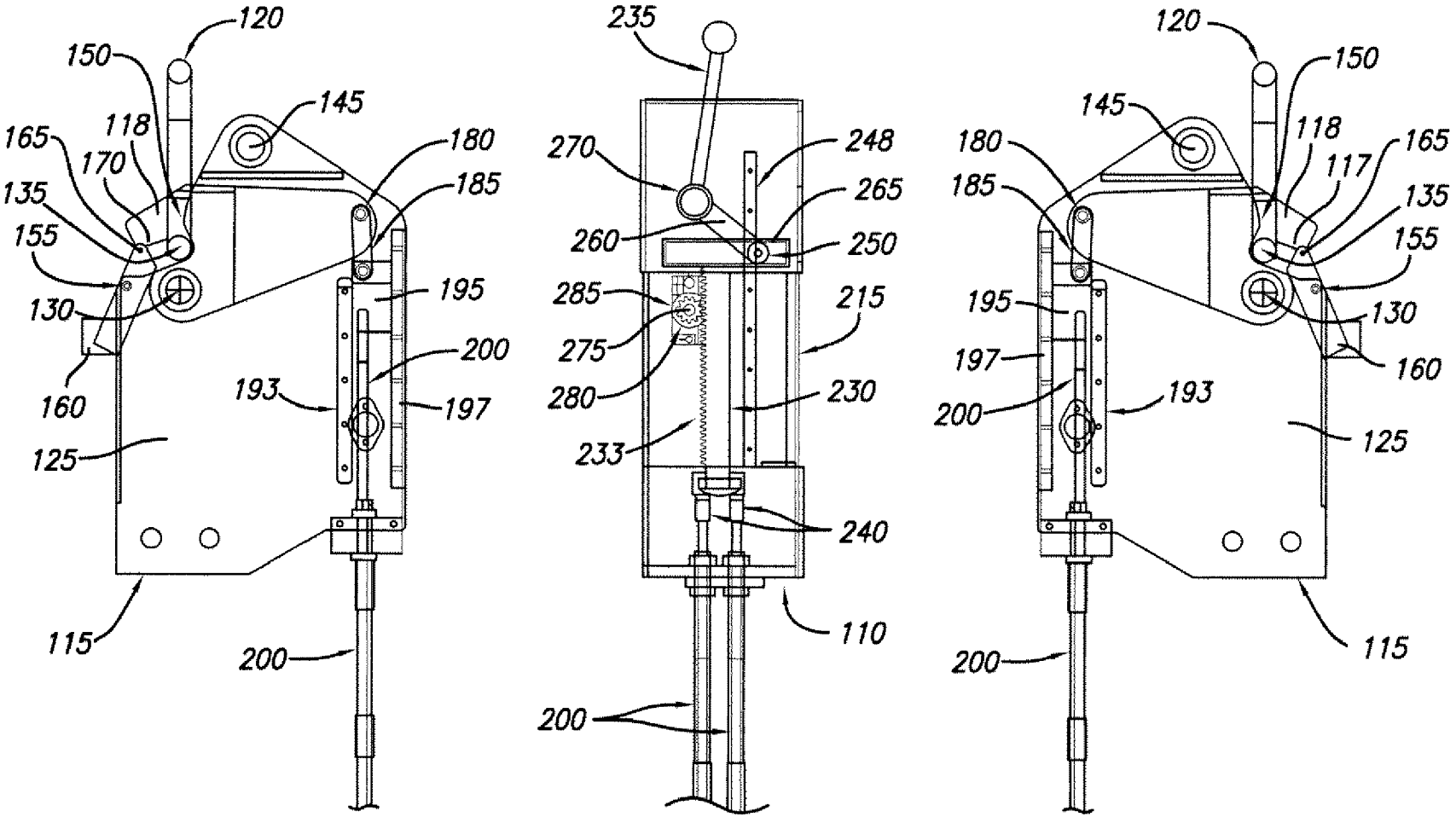
FIG. 3 is an enlarged view of the lifeboat disengagement system of FIG. 2 in the engaged configuration, in accordance with the principles of the present invention.
Figure 4:
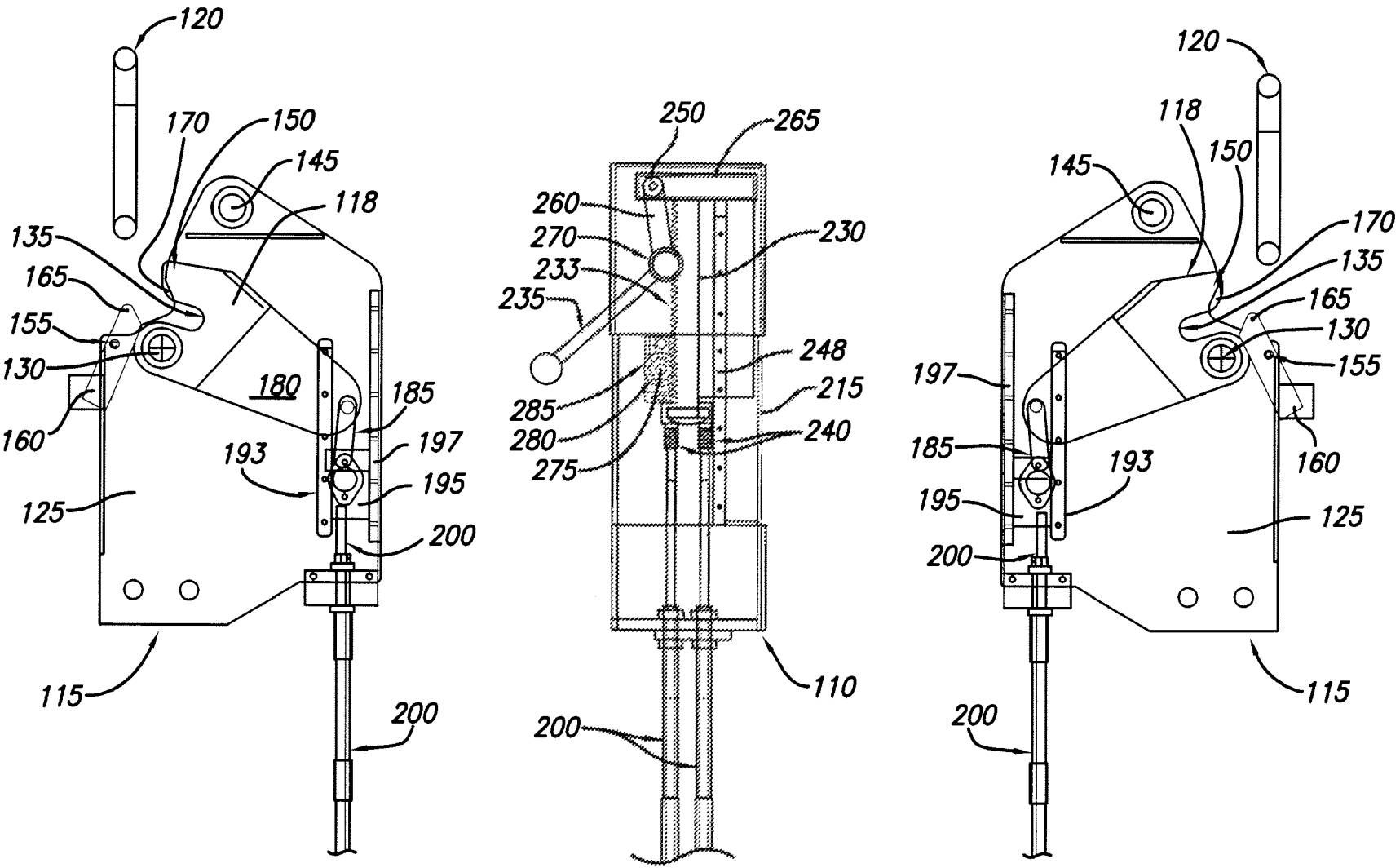
FIG. 4 is a side view of the lifeboat disengagement system of FIG. 3 in a disengaged configuration, in accordance with the principles of the present invention.

Referring to FIGS. 2-7, a preferred lifeboat disengagement system 100 for supporting and releasing twin fall lifeboats is illustrated. In particular, FIGS. 2 and 3 depict the lifeboat disengagement system 100 in an engaged configuration, wherein a pair of lifting links 120 are secured by corresponding hook assemblies 115, whereas FIG. 4 depicts the lifeboat disengagement system 100 in a disengaged configuration, wherein a single lifeboat release assembly 110 has been employed to release the lifting links 120 from the hook assemblies 115 simultaneously. The lifeboat disengagement system of the invention provides positive locking under load including a load over center design such that a load of the lifeboat is in line with a center of hook rotation.

Figure 5:
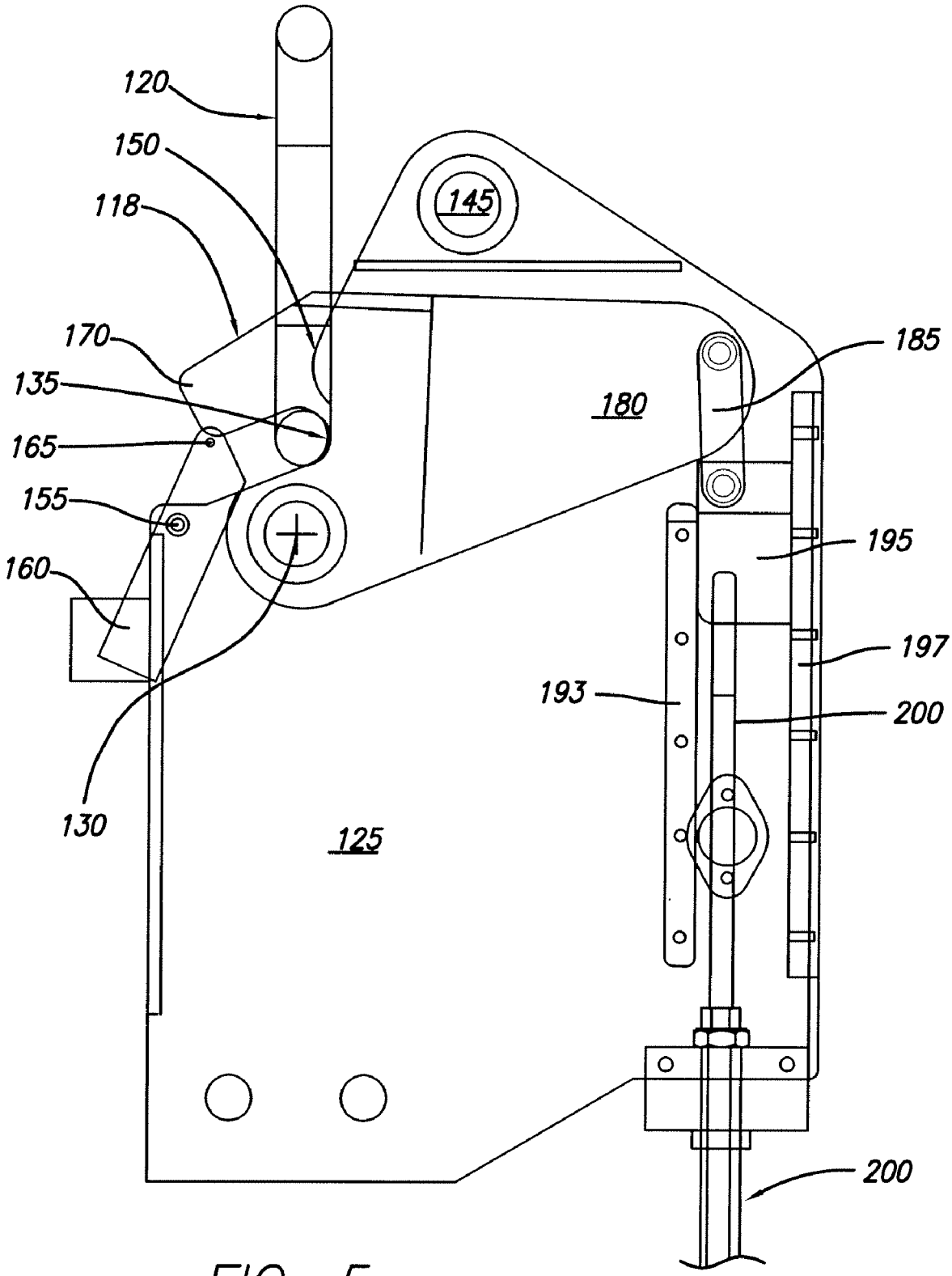
FIG. 5 is an enlarged view of a hook assembly of the preferred lifeboat disengagement system of FIG. 2 shown in the engaged configuration.
Figure 6:
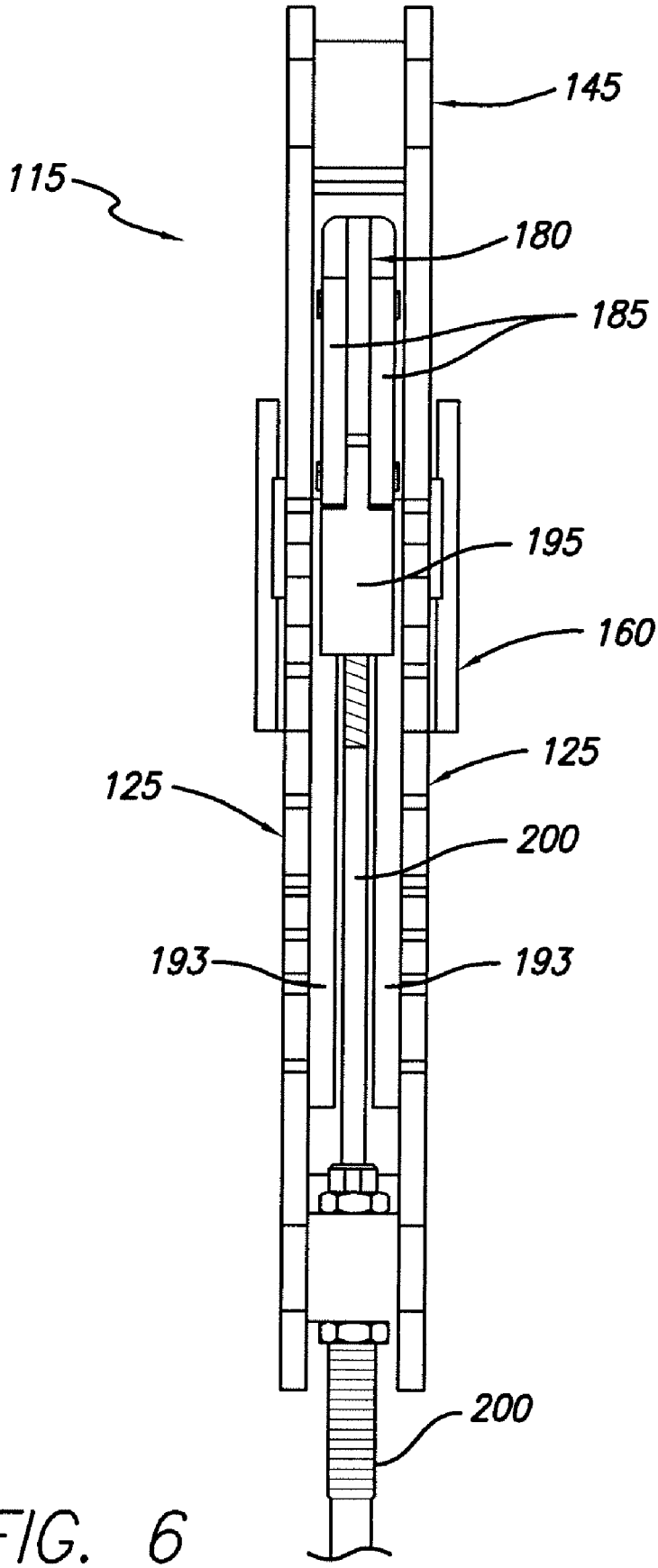
FIG. 6 is an end view of the hook assembly of FIG. 5.
Figure 7:
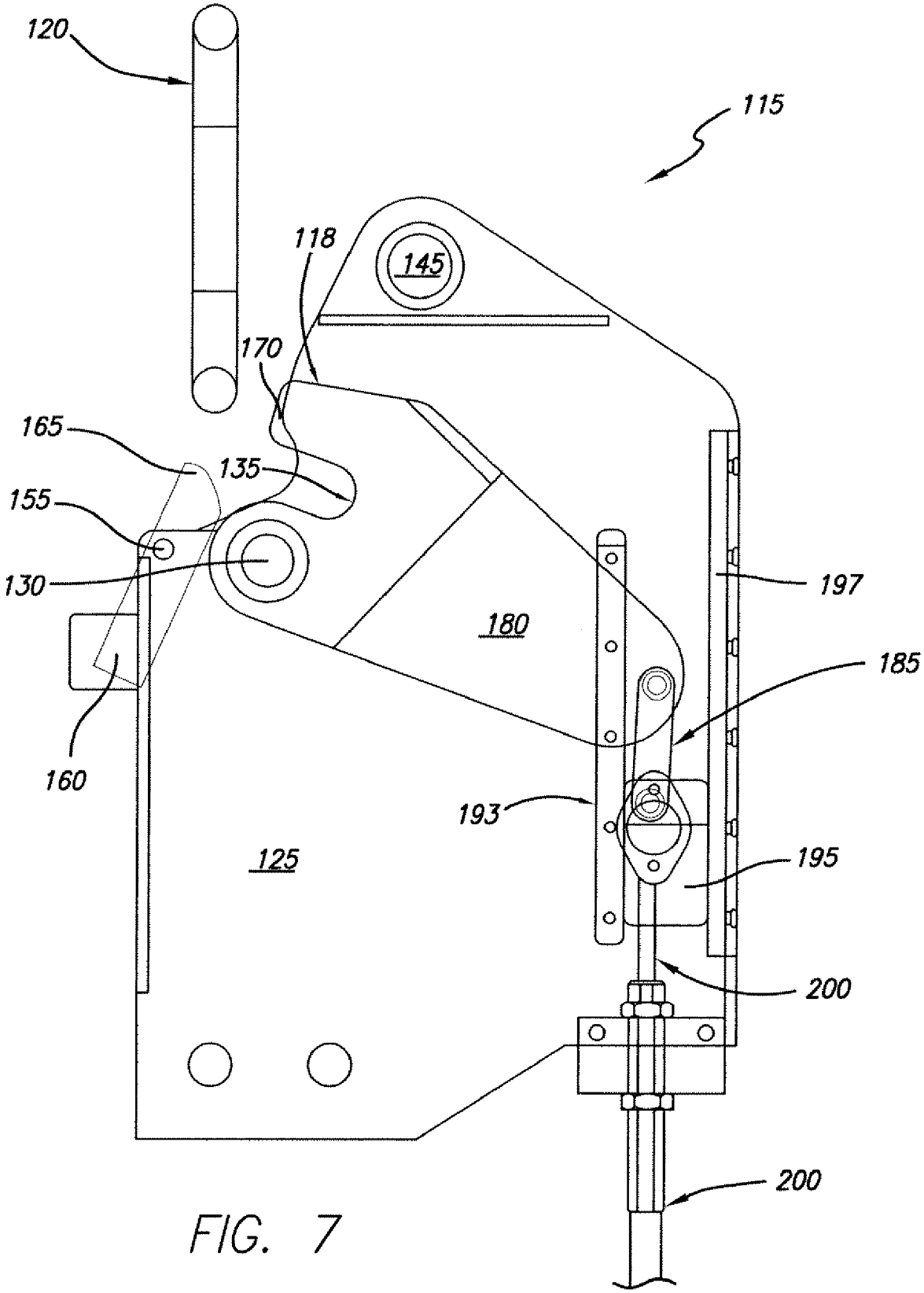
FIG. 7 is an enlarged view of a hook assembly of the preferred lifeboat disengagement system of FIG. 4 shown in the disengaged configuration.

FIG. 5 illustrates an enlarged view of a hook assembly 115 of FIGS. 2 and 3 in the engaged configuration, while FIG. 6 depicts an end view of the hook assembly 115 of FIG. 5. FIG. 7 illustrates an enlarged view of a hook assembly 115 of FIG. 4 in the disengaged configuration showing the positioning of the hook 118 between the two plates 125. The disengagement system 100 provides positive locking under load until the lifeboat release assembly 110 is used to disengage the hook assemblies 115 simultaneously. The hook assemblies 115 feature stable hooks, wherein the load of the lifeboat locks the hooks such that they do not release under load (i.e., load of the lifeboat is not employed to open the hook). Once the boat is afloat in the water, the operator may then pull the hook release handle and open the hook.

The lifeboat disengagement system 100 of the invention may be employed for a variety of purposes such as moving and servicing lifeboats together with other equipment. In operation, the lifeboat release assembly 110 is used to disengage the lifting links 120 simultaneously from stable hooks 118 of corresponding hook assemblies 115. More particularly, each hook assembly 115 comprises a hook 118 that is positioned between a pair of vertical plates 125 (which form a housing) by way of a shaft 130 such that the hook 118 is capable of rotating about the shaft 130. According to some embodiments, the housing may be provided with a covering to prevent environmental contamination or damage. The hook 118 includes an engaging surface 135 that is provided with a predetermined shape. In the illustrated embodiment, the engaging surface 135 is arcuate and is formed at a substantially constant radius from the shaft 130. The engaging surface 135 is positioned such that the face of the housing assists in the positive disengaging of the lifting link 120 from the hook 118 upon release and rotation of the hook 118.

Both of the plates 125 are drilled to form a lifting eye 145 suitable for hauling, hoisting or otherwise positioning the lifeboat or other equipment attached to the hook assembly 115. Each plate 125 is provided with a release surface 150 which is vertically extended and curved relatively toward the rearward portion of the hook 118. During disengagement, the release surface 150 acts to positively disengage the lifting link 120 or other structure held by the hook 118 on its engaging surface 135. Additionally, each plate 125 is drilled at its forward end, and a pin 155 is provided for rotatably connecting a counter weighted retaining device 160. In the engaged configuration depicted in FIGS. 2, 3 and 5, the hook 118 is engaged with the lifting link 120 by passing the link 120 between the hook 118 and the counter weighted retaining device 160, overcoming the counter weight. The counter weight then biases the retaining device 160 back to its substantially closed position, such that a distal end 165 of the retaining device 160 is in close proximity to a distal end 170 of the hook 118. The entire hook assembly 115, with the exception of the hook and latch structure, may be covered with an enclosure (not depicted) to protect it from the elements, for example when used on board a ship.

With further reference to FIGS. 2 and 3, the hook 118 is supported by the plates 125, and the shaft 130 rotatably mounts the hook 118 between the plates 125. The hook 118 is illustrated in its engaged configuration, with the pin 155 positioning the counter weighted retaining device 160. In one embodiment the hook 118 extends to form a rearward structure 180 including two links 185 for connecting the hook 118 to a guide block 195 connecting to one end of a flexible cable 200. The hook assembly 115 further comprises guides 193 (2) and 197 attached in between the plates 125, which guides the guide block 195 in a vertical motion for the passage of the flexible cable 200. The other end of the flexible cable 200 is attached to the lifeboat release assembly 110 including housing 215.

In FIGS. 2 and 3, the lifeboat release assembly 110 is in its normal position such that the lifting links 120 remain engaged with the hooks 118, whereas in FIG. 4, the lifeboat release assembly 110 has been activated. In particular, a release handle 235 of the lifeboat release assembly 110 has been pulled by an operator such that the flexible cables 200 have been pulled, thereby releasing the lifting links 120 from the hooks 118. The lifeboat release assembly 110 includes housing 215, release handle 235, a weighted rack assembly 230 having a plurality of teeth 233, and a pair of Heim joints 240 attached to the flexible cables. The release handle 235 is connected to a lever arm/wheel assembly 260 which is attached to a lever arm/wheel encasement 265 via wheel 250, such that the wheel 250 may rotate in a transverse direction within the wheel encasement 265. The lever arm/wheel encasement is attached to an upper end of the weighted rack 230. By pulling the release handle 235, the lever arm/wheel assembly 260 is rotated about boss 270 in a counter-clockwise direction, thereby causing an upward displacement of the weighted rack 230 and pulling the flexible cables 200. The lever arm wheel assembly comes to rest beyond its vertical center of rotation, which holds the hook in its open configuration until such time as the operator closes the hook for lifeboat retrieval.

According to a preferred implementation, the lifeboat release assembly 110 is disposed inside the lifeboat such that the release handle 235 is an internal device. Existing lifeboats may be retrofitted by installing the lifeboat disengagement system 100 of the invention with limited modification to the existing lifeboat structure. Additionally, less motion is required to open and close the hooks 118. Specifically, the rotary motion of the handle is converted to the linear motion of the weighted rack 230. According to some embodiments, the release handle 235 must only be rotated approximately 160° to fully open the hooks 118. All moving parts of the lifeboat release assembly 110 are contained within the housing 215, thus preventing the interference of moving parts. If the operator is able to rotate the hook release handle 235 and move it, then the lifeboat is safely afloat in the water, the tension has been removed from the falls and the hooks 118 will open. However, if the operator pulls on the hook release handle 235 and cannot move it, then the lifeboat is suspended in the air, or a tension remains on the falls, and the hooks 118 will not open. To close the hooks to the normal position illustrated in FIGS. 2 and 3, the operator pushes the release handle 235 up until it rests in its upper position.

Referring to FIG. 3, when an operator pulls the handle 235 of the lifeboat release assembly 110, the release arm 260 is rotated in a counter-clockwise direction. The rotation of the release arm 260 lifts the lever arm/wheel encasement 265 attached to the weighted rack 230. The rotation of the release arm 260 about boss 270 causes the wheel 250 to rotate to one end of the wheel encasement 265 during the lift and then back to the other end of the wheel encasement 265 at the end of the lift. The lever arm wheel assembly comes to rest beyond its vertical center of rotation, which holds the hook in the open configuration until the operator closes the hook for lifeboat retrieval. The upward motion of the weighted rack 230 pulls both flexible cables 200, which are attached at their first ends to the rack 230 with pins 245 and Heim joints 240. The other ends of the flexible cables 200 are attached to the hooks 118 via joints 185, such that pulling the cables 200 causes the hooks 118 to rotate about shafts 130. As illustrated in FIG. 3, the rotation of the hook 118 causes the distal end 170 of the hook 118 to be displaced away from the distal end 165 of the retaining device 160, thereby releasing the lifting link 120.

Figure 8:
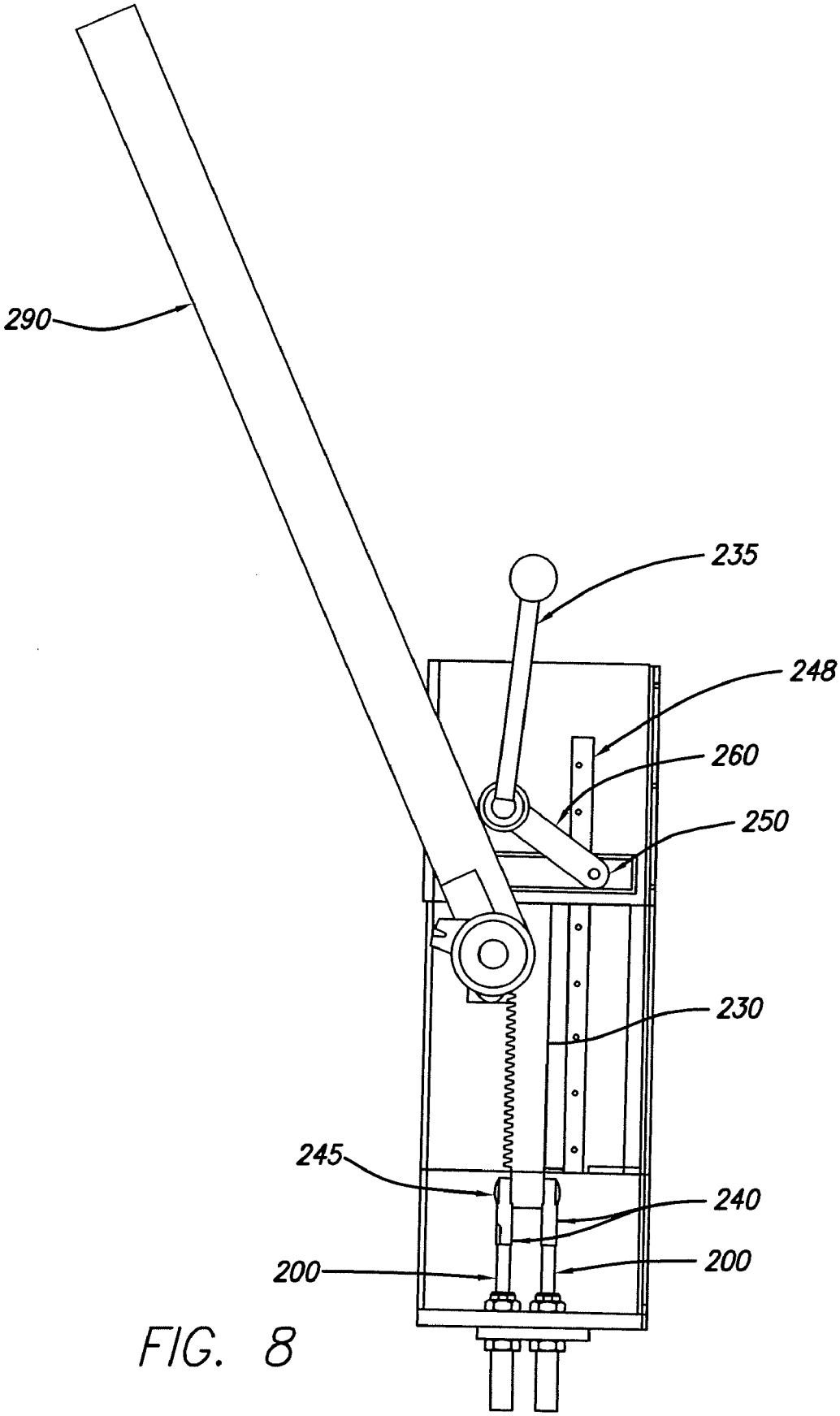
FIG. 8 is a side view of the release device of the preferred lifeboat disengagement system of FIG. 3 including an emergency ratchet lever in an engaged configuration.
Figure 9:
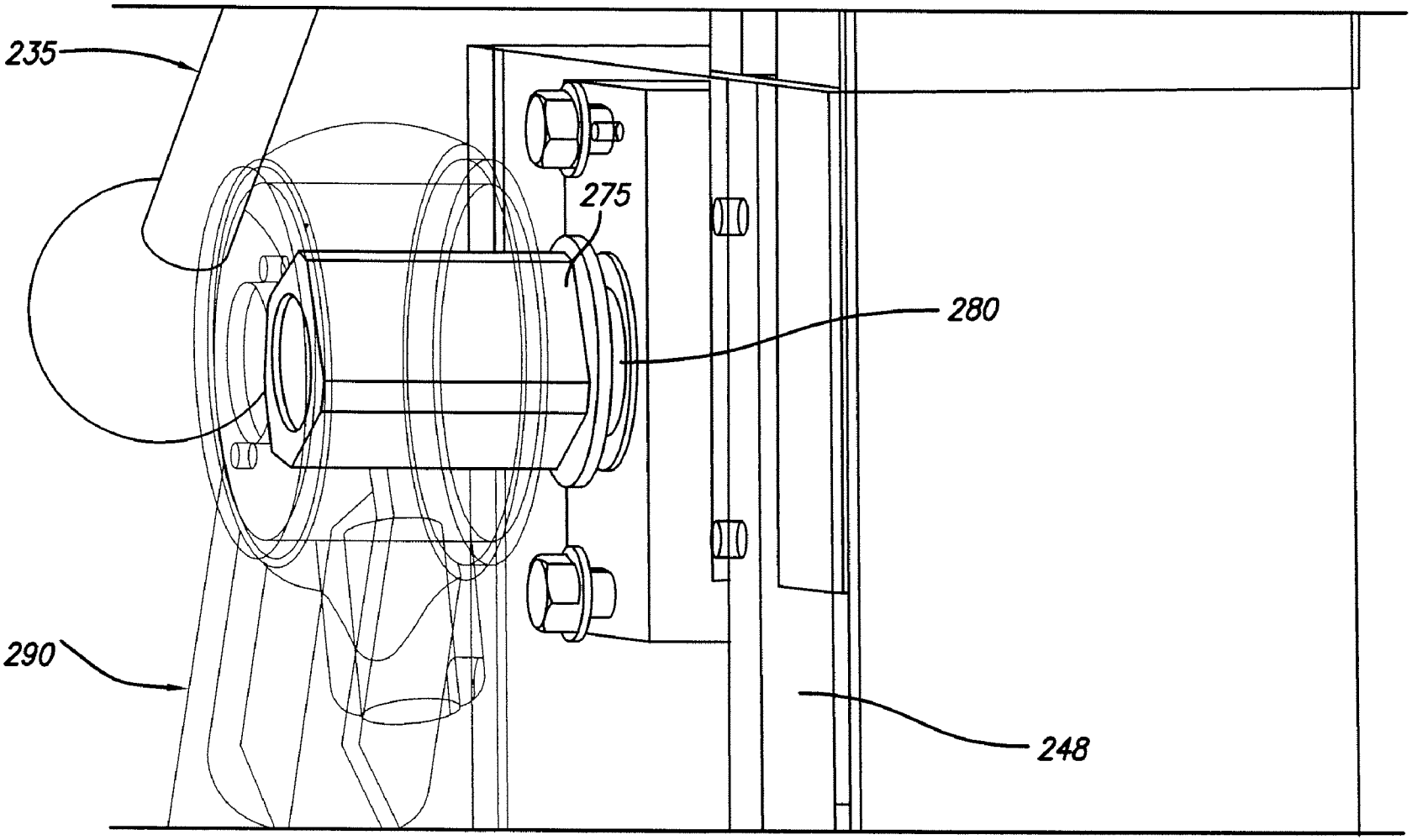
FIG. 9 is an enlarged perspective view of the release assembly of FIG. 8 shown in the engaged configuration.
Figure 10:
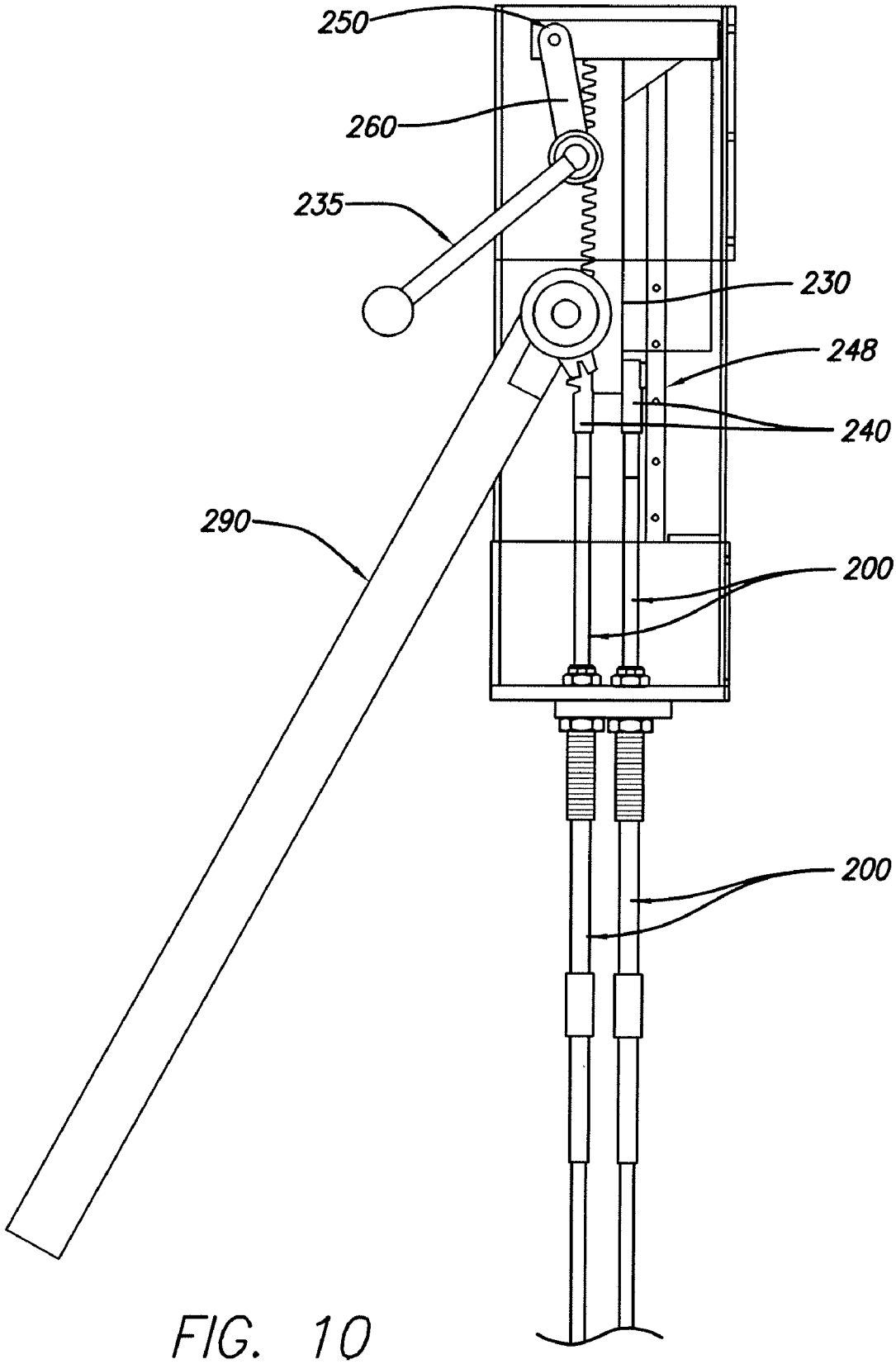
FIG. 10 is a side view of the release device of the preferred lifeboat disengagement system of FIG. 4 including the additional emergency ratchet lever in a disengaged configuration.

Referring to FIGS. 8-10, regulation requires that in the event of an emergency, the hook design shall provide an ability to release the hooks when under load. In such a situation, the operator may not be able to successfully release the hooks by pulling on the release handle. According to one embodiment of the invention, this is accomplished by manually installing an emergency ratchet lever 290 onto the square end 275 of an emergency release shaft of the lifeboat release assembly. Specifically, the square end 275 is disposed on a keyed shaft 280 on which is mounted a keyed pinion 285, which engages the teeth 233 of the weighted rack 230, such that when the emergency ratchet lever 290 is inserted and pulled in a counter-clockwise direction, the weighted rack is caused to move in an upward direction, thereby pulling the cables 200 and releasing the loaded hooks 118. In particular, FIGS. 8 and 9 depict the emergency ratchet lever 290 engaged onto the square end 275 of the emergency release shaft with the hooks in the engaged position as per FIG. 2. The ratchet lever 290 is rotated through 90° five to six times, rotating the keyed shaft 280 and, in turn, the keyed pinion 285, thus lifting the weighted rack 230 and disengaging the hooks while under load. FIG. 10 depicts the emergency disengagement ratchet lever 290 at hook disengagement.

Figure 11:
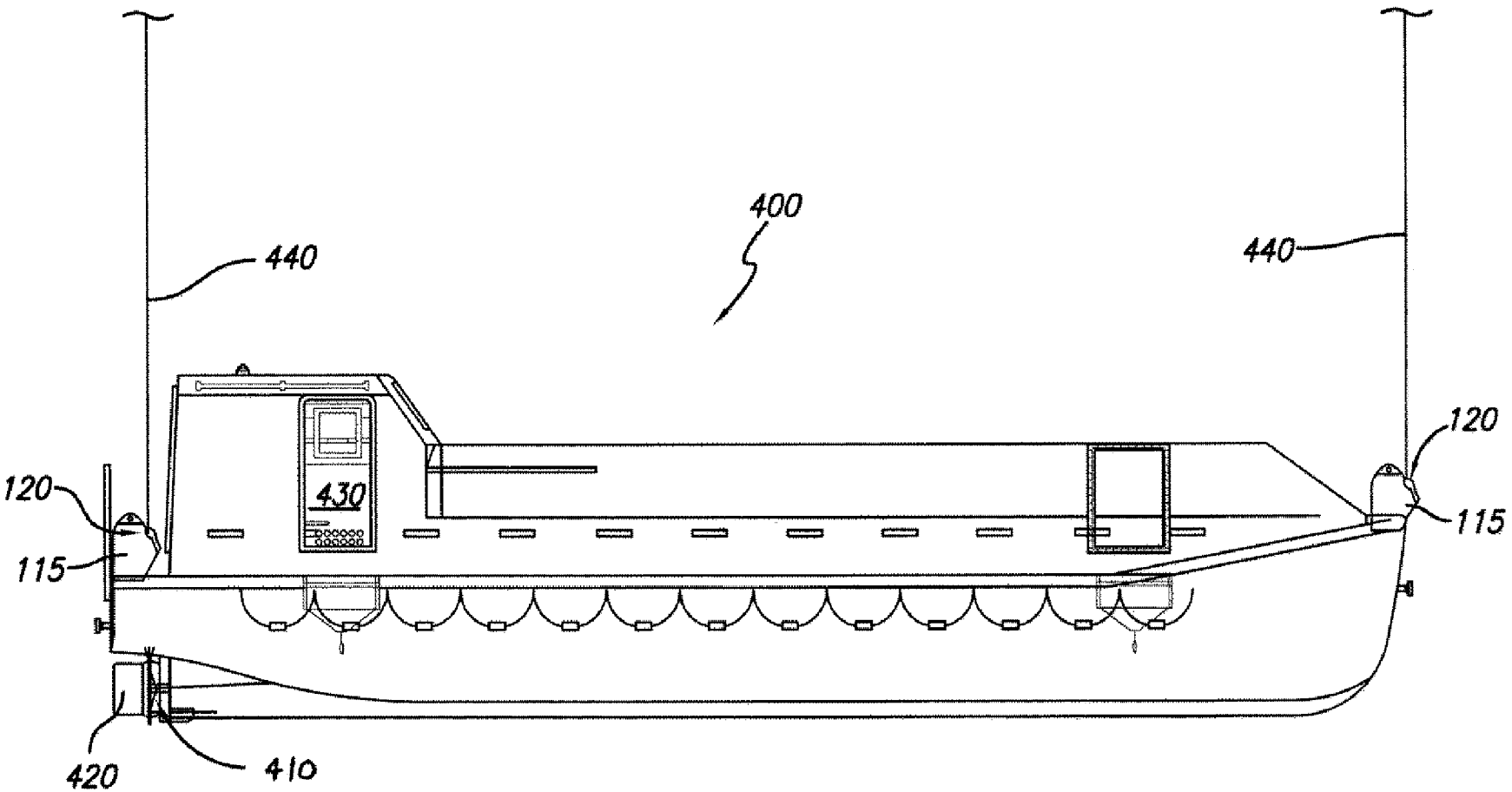
FIG. 11 is a side view of an exemplary lifeboat that is provided with a pair of hook assemblies, in accordance with the principles of the invention.

Referring to FIG. 11, an exemplary lifeboat 400 is provided with a pair of hook assemblies 115 on an upper surface of the lifeboat 400. The lifeboat 400 includes a propeller 410 and a rudder 420, and can be entered through a hatch 430 approached from the decking. In operation, a lowering device (not shown) may be employed to lower the lifeboat 400 into the water using a pair of cables 440 having lifting links 120 that are releasably attached to corresponding hook assemblies 115. Once the lifeboat 400 is in the water, the lifting links 120 are released from the hook assemblies as described hereinabove. After use, the lowering device may be used to lift the lifeboat 400 out of the water.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof, the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

What is claimed is:

1. A system for supporting and releasing a twin fall lifeboat, comprising:

a pair of hooks releasably engaged with a corresponding pair of lifting links; and a lifeboat release assembly including a release handle, a release arm, an emergency release shaft, a weighted rack, and a pair of flexible cables attached at first ends to the rack and attached at second ends to the hooks, wherein the release handle is attached to the release arm at a pivot point, wherein the release arm Deludes a wheel disposed within a wheel encasement attached to the weighted rack;

wherein the system includes an engaged configuration in which the lifting links are secured by the hooks;

wherein the release handle is pulled to release the lifting links from the hooks substantially simultaneously; and further comprising an emergency ratchet lever for engagement with the emergency release shaft for releasing the twin fall lifeboat under load.

2. The system of claim 1, wherein the emergency ratchet lever is configured to be engaged on a square end of the emergency release shaft.

3. The system of claim 1, wherein pulling the release handle causes the release arm to rotate about a boss, thereby lifting the weighted rack and pulling the flexible cables, and wherein the rotation of the release arm about the boss causes the wheel to rotate transversely within the wheel encasement while the weighted rack is being lifted.

4. The system of claim 1, wherein the system provides positive locking under load including a load over center design such that a load of the lifeboat is in line with a center of hook rotation.

5. The system of claim 4, wherein the load over center design prevents the hook from opening inadvertently and eliminates the need for a hydrostatic device.

6. The system of claim 1, wherein:

the hooks comprise stable hooks; and a load of the lifeboat locks the hooks such that they do not release under load.

7. The system of claim 6, wherein the release handle is pulled by an operator to release the lifting links from the hooks once the lifeboat is afloat in water.

8. The system of claim 1, wherein each hook is positioned between a pair of plates and is capable of rotating about a shaft.

9. The system of claim 8, wherein the hook includes an engaging surface that is provided with a predetermined arcuate shape.

10. The system of claim 8, wherein the plates include a release surface which is vertically extended and curved relatively toward a rearward portion of the hook.

11. The system of claim 10, wherein the release surface acts to positively disengage the lifting link held by the hook during disengagement.

12. The system of claim 8, further comprising a counter weighted retaining device which captures a lifting link before a load is applied.

13. The system of claim 12, wherein:

the hook is engaged with the lifting link by passing the lifting link between the hook and the counter weighted retaining device, overcoming the gravity of the counter weight; and after engagement, the counter weighted retaining device returns to its original closed position, such that a distal end of the counter weighted retaining device is in close proximity to a distal end of the hook.

14. The system of claim 1, wherein a square end of the emergency release shaft is disposed on a keyed shaft on which a keyed pinion is mounted, wherein the keyed pinion engages a plurality of teeth of the weighted rack, such that when the emergency ratchet lever is pulled, the weighted rack is caused to move in an upward direction, thereby pulling the cables and releasing the loaded hooks.

15. The system of claim 14, wherein the ratchet lever is rotated through 90° four to five times in order to lift the weighted rack and disengage the hooks while under load.

16. A system for supporting and releasing a twin fall lifeboat, comprising:

a pair of hooks releasably engaged with a corresponding pair of lifting links; and a lifeboat release assembly including a release handle, a release arm, an emergency release shaft, a weighted rack, and a pair of flexible cables attached at first ends to the rack and attached at second ends to the hooks, wherein the release handle is attached to the release arm at a pivot point, wherein the release arm includes a wheel disposed within a wheel encasement attached to the weighted rack;

wherein the system includes an engaged configuration in which the lifting links are secured by the hooks;

wherein the release handle is pulled by an operator, rotating the release arm about the a boss, thereby lifting the weighted rack and pulling the flexible cables releasing the lifting links from the hooks substantially simultaneously; and further comprising an emergency ratchet lever for engagement with the emergency release shaft for releasing the twin fall lifeboat under load.

17. The system of claim 16, wherein the emergency ratchet lever is configured to he engaged on a square end of the emergency release shaft of the lifeboat release assembly and pulled in a counter-clockwise direction to release twin fall lifeboat under load.

18. The system of claim 16, wherein the ratchet lever is rotated through 90° four to five times in order to lift the weighted rack and disengage the hooks while under load.

19. A twin fails lifeboat disengagement system for comprising:

a pair of hook assemblies; and a lifeboat release assembly including a release handle, a release arm, a weighted rack, and a pair of flexible cables attached at first ends to the rack and attached at second ends to a hook, wherein the release handle is attached to the release arm at a pivot point, wherein the release arm includes a wheel disposed within a wheel encasement attached to the weighted rack.

20. The system of claim 19, further comprising an emergency ratchet lever for use in releasing the twin fall lifeboat under load, wherein the emergency ratchet lever is engaged on a square end of an emergency release shaft of the lifeboat release assembly and pulled in a counter-clockwise direction to release twin fait lifeboat under load.

21. A twin falls lifeboat comprising:

a lifeboat;

a twin falls lifeboat disengagement system coupled to the lifeboat, the disengagement system comprising:

a pair of hook assemblies; and a lifeboat release assembly including a release handle, a release arm, a weighted rack, and a pair of flexible cables attached at first ends to the rack and attached at second ends to a hook, wherein the release handle is attached to the release arm at a pivot point, wherein the release arm includes a wheel disposed within a wheel encasement attached to the weighted rack.

22. The system of claim 21, further comprising an emergency ratchet lever for se in releasing the twin fall lifeboat under load, wherein the emergency ratchet lever is engaged on a square end of an emergency release shaft of the lifeboat release assembly and pulled in a counter-clockwise direction to release twin fall lifeboat under load.

* * * * *

UNITED STATES PATENT AND TRADEMARK OFFICE

CERTIFICATE OF CORRECTION

PATENT NO. : 7,832,350 B2
APPLICATION NO. : 11/841844
DATED : November 16, 2010
INVENTOR(S) : Tony Mora et al.

It is certified that error appears in the above-identified patent and that said Letters Patent is hereby corrected as shown below:

Claim 1, column 11, line 11, "Deludes" should be changed to -- includes --.
Claim 16, column 12, line 26, please delete the word "the" after the word about.
Claim 21, column 13, line 4, after the word lever for, please delete "se" and replace with -- use --.

Signed and Sealed this
Twenty-fifth Day of January, 2011

David J. Kappos

David J. Kappos
*Director of the United States Patent and Trademark Office*